US006219883B1

(12) United States Patent
Keichline

(10) Patent No.: US 6,219,883 B1
(45) Date of Patent: Apr. 24, 2001

(54) LOCKING ASSEMBLY FOR PUSH BROOM

(75) Inventor: Darwin Keichline, Plantsville, CT (US)

(73) Assignee: Cyber-Mation, Inc., Cheshire, CT (US)

( * ) Notice: Subject to any disclaimer, the term of this patent is extended or adjusted under 35 U.S.C. 154(b) by 0 days.

(21) Appl. No.: 09/330,700

(22) Filed: Jun. 11, 1999

(51) Int. Cl.[7] ..... A46B 9/10

(52) U.S. Cl. ..... 16/110.1; 16/422; 15/176.2

(58) Field of Search ..... 16/422, 435, 110.1, 16/DIG. 41; 403/397.3, 383, 391, 277, 263, 361; 15/176.2

(56) References Cited

U.S. PATENT DOCUMENTS 1,043,146 * 11/1912 Schiess ..... 16/422 X
1,771,189 * 7/1930 Palmer ..... 16/422 X
2,689,967 * 9/1954 Mackey ..... 15/176.2 X
3,707,739 * 1/1973 Hermann, Jr. ..... 15/176.2
4,293,972 10/1981 Pomares .
4,541,139 * 9/1985 Jones et al. ..... 15/176.2 X
4,727,618 * 3/1988 Mahoney ..... 15/176.2 X
5,161,278 * 11/1992 Tomm ..... 16/422 X
5,172,447 * 12/1992 Tomm ..... 16/422 X
5,210,898 * 5/1993 Carey ..... 15/176.2
5,502,862 * 4/1996 Vosbikian ..... 16/422 X
5,890,254 * 4/1999 Courtney et al. ..... 16/422 X

* cited by examiner

*Primary Examiner*—Robert J. Sandy
(74) *Attorney, Agent, or Firm*—Alix, Yale & Ristas, LLP

(57) ABSTRACT

An assembly for locking a handle to an implement head having convergent bores for mounting the handle. The assembly includes a handle mountable to one head bore with a transverse aperture located adjacent one end of the handle. A locking plug includes a locking pin. When the locking plug is mounted to the other head bore, the locking pin projects into the handle aperture, thereby locking the handle to the head. A flexible restraint may bridge the locking plug and handle.

27 Claims, 9 Drawing Sheets

LOCKING ASSEMBLY FOR PUSH BROOM

BACKGROUND OF THE INVENTION

This invention relates generally to an assembly for attaching handles to an implement head such as a broom head. More particularly, the invention relates to an assembly for threadably attaching a handle to an implement head and locking the handle so that it cannot be detached from the head during usage.

A standard implement for which the invention has applicability comprises a separable, elongated handle and one of a variety of implement heads, including brooms, mops, squeegees, etc. For a push broom, the head is made up of bristles and a rigid bristle supporting base, with the base often made of wood, plastic, light metal or other rigid material. The head typically has two predefined, centrally located holes or mounting bores through its upper surface in angularly offset relationship for receiving one end of the handle. One hole is located on a front side of the head and the second hole is located on an opposite side of the head. This allows the handle to be switched from one hole to the other such as, for example, when the bristles become worn in one pushing direction. The holes are typically threaded to allow engagement with the end of the handle which has complementary threads.

While the threaded attachment of the handle to the head provides a functional implement, several inherent problems are present with this arrangement. During use, the threaded attachment between the handle and head routinely loosens due to a force producing a torque imbalance wherein the head is urged to pivot about the handle. If not constantly tightened, the head may become completely separated from the handle. Over tightening of the handle can lead to stripped threads on the handle or within the mounting bore. The distribution and transport of assembled push brooms, with their heads jutting from their handles, is cumbersome and awkward. Shipment of assembled brooms also requires additional valuable cargo or container space compared to shipment of unassembled brooms. Displaying assembled push brooms for retail merchandising and sale presents similar handling and space requirement problems.

SUMMARY OF THE INVENTION

It is an object of the invention to provide a simple, convenient and reliable method for securing a handle to an implement head.

It is another object of the invention to provide a handle-securing assembly which may be used with any standard two-holed head without modification.

It is a further object of the invention to provide an apparatus which locks the handle and head together when assembled and also prevents misplacement of the handle and head when unassembled.

These and other objects are accomplished by the present invention which comprises an elongated handle and a locking plug for an implement head. The elongated handle has a first end including a threaded portion which is engageable with a threaded mounting bore located in the head. The handle first end includes at least one transverse aperture. The locking plug includes a head connected to a threaded shank and terminates in a locking pin projecting from the shank. The locking pin is preferably coaxial with a locking plug longitudinal axis and sized to fit within the handle transverse aperture.

The implement head includes two angularly offset mounting bores. The mounting bores are internally threaded and have intersecting axes. In use, the handle first end is threadably engaged within one of the mounting bores. The locking plug shank is threadably engaged within the other of the mounting bores and the locking pin is approximately axially aligned with the handle transverse aperture. Further threaded engagement of the locking pin shank within the mounting bore drives the pin into the handle transverse aperture, locking the handle from rotational and axial movement and thereby securing the handle to the head. Preferably, the locking plug shank defines a face which is engageable against the outside surface of the handle first end when the pin is driven into the extended portion aperture to further secure the handle. The handle first end portion may also include radially arrayed faces to better cooperate with the shank face. The locking plug preferably includes provisions for either manual actuation or for mechanical actuation in cooperation with a tool.

In a different embodiment, the handle first end is coaxially mounted to a ferrule. The ferrule includes a threaded portion coaxial with, and projecting from, the handle first end; and the previously described transverse aperture. In use the handle and ferrule assembly is threadably engaged with one head mounting bore and the locking plug threadably engaged with the other head mounting bore, as previously described, so that the locking pin is driven within the ferrule transverse aperture. The locking plug face may also engage the outside surface of the ferrule threaded portion.

In another embodiment, the locking plug pin is moveable within the locking plug between an extended position projecting from the shank face and a retracted position. The pin is biased toward the projected position and includes an attachment for moving the pin to the retracted position. With the handle or ferrule assembly threadably engaged into one mounting bore, the locking plug can be threadably engaged with the other mounting bore to drive the locking pin, in the extended position, into the transverse aperture, thereby securing the handle to the head. If disassembly of the handle from the head is desired, the pin may be moved to the retracted position, so that the pin is withdrawn from the transverse aperture, and rotation of the handle is allowed. Thus, the handle can be removed from, and reattached to, the head without removal of the locking plug. In a variation of this embodiment, the displaceable pin is permanently mounted to the implement head, without the use of the threaded plug. Movement of the pin against its bias to the retracted position still allows the handle to be rotated for assembly or disassembly. With the pin biased into the transverse aperture, the handle is secured to the head.

In any variation in which the aperture is a transverse bore, the engagement of the locking pin and bore immobilizes the handle from both rotational and axial movement. This allows the use of a non-threaded handle or ferrule which mounts to the head by a slip or interference fit within a non-threaded mounting bore.

In a further embodiment, the handle or ferrule threaded end is bisected by a transverse slot. Threaded engagement of the handle or ferrule threaded end within one mounting bore locates the slot at the intersection of the mounting bore axes. Threaded engagement of the locking plug shank with the other head mounting bore drives the locking pin into engagement with the transverse slot, thereby rotationally immobilizing the handle and securing the handle to the head. Alignment of the locking pin with the transverse slot is less critical than alignment of the locking pin and a transverse aperture.

A flexible leash or retainer may connect the locking plug to the handle or ferrule. In this manner, the locking plug and handle cannot be separated and lost. Further, if the locking plug is threadably engaged within the head, the handle will be connected to the head by the leash, preventing misplacement but allowing more compact storage of the head adjacent the longitudinal axis of the handle.

In any embodiment, the assembled handle is secured to the head so that no rotational (and in some embodiments axial movement) of the handle with relation to the head is possible. While the invention allows the handle to be securely fastened to a head, it should be noted that the handle is quickly and easily removable after removal of the locking plug, or in some embodiments movement of the locking plug pin to the retracted position.

BRIEF DESCRIPTION OF THE DRAWINGS

Other objects and advantages of the invention will be evident to one of ordinary skill in the art from the following detailed description, made with reference to the accompanying drawings, in which.

DESCRIPTION OF THE PREFERRED EMBODIMENTS

Figure 1:
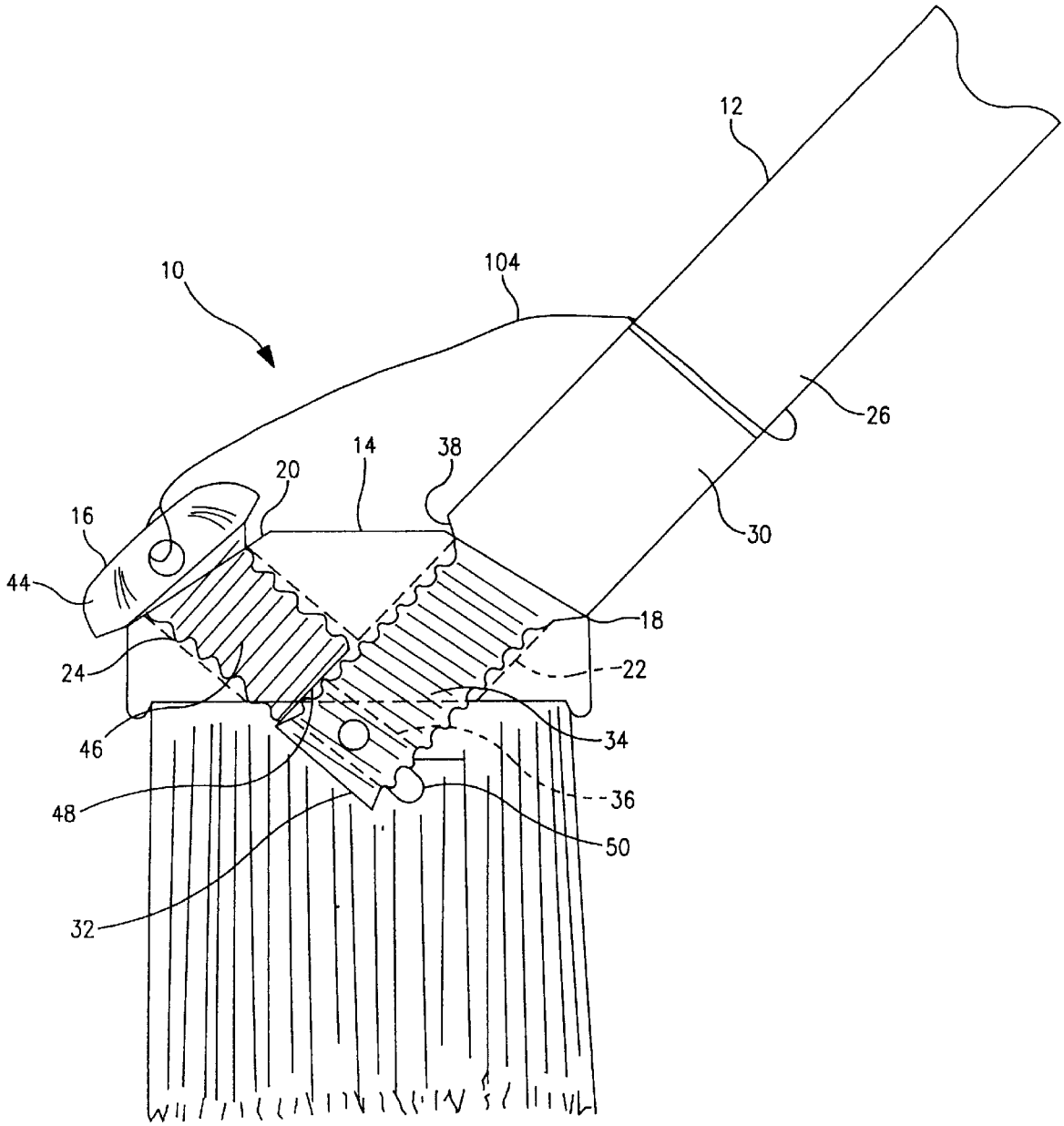
FIG. 1 is a side view, partly in schematic and partly in phantom, of a locking assembly of the invention installed to a broom head, with portions of the broom head removed to illustrate the invention.

An inventive implement in accordance with the present invention, indicated generally in FIG. 1 as 10, comprises an elongated handle 12 mounted via a ferrule 30 to a head 14 and secured by a locking plug 16. The implement head 14 includes an upper surface with two angularly offset mounting faces 18, 20. The mounting faces 18, 20 each include a predefined, centrally located, typically internally threaded, mounting bore 22, 24 respectively. The mounting bores 22, 24 extend into, or through, the thickness of the head 14. The mounting bores 22, 24 each have an axis angularly offset from each other, typically at or around 90°, with the axes intersecting.

A handle 12 includes a control end (not shown) for manually handling and controlling the implement head 14 and an opposing attachment end 26. The attachment end 26 typically terminates in a ferrule 30 which projects along the longitudinal axis of the handle 12. The ferrule 30 includes a threaded portion 34. The threaded portion 34 is adapted for threadable engagement within each of the head mounting bores 22, 24. The ferrule 30 includes at least one transverse aperture 36 adjacent the free end 32. The transverse aperture in this embodiment is preferably a cylindrical bore through opposing sides of the ferrule 30. Naturally, multiple, radially spaced apertures may be used. The aperture also need not completely diametrally traverse the ferrule 30. The aperture 36 is perpendicular to the handle longitudinal axis. The ferrule 30 should be made of metal or other material strong enough to withstand twisting and pushing forces. Alternatively, the ferrule may be constructed of plastic overlying a metal core.

The junction of the ferrule threaded portion 34 and mounted end creates a shoulder 38. The shoulder 38 acts as a rotational stop against the mounting face 18, thereby limiting threaded engagement of the ferrule 30 within the head mounting bore 22. The shoulder 38 also acts to transmit force between the handle 12 and the head 14. When the ferrule threaded portion 34 is sufficiently threadably engaged with the mounting bore 22, the transverse aperture 36 will be positioned at the intersection of the mounting bore axes.

Annular spacers (not shown) fitting over the ferrule threaded portion 34 and disposed between the mounting face 18 and ferrule shoulder 38 may be used to vary the axial position of the transverse aperture 36 within the mounting bore 22, while maintaining engagement of the ferrule shoulder 38 and mounting face 18. Thus, the spacers, would allow a single handle 12 and ferrule 30 to be used with a variety of different heads, having different mounting bore depths while still positioning the transverse aperture 36 at the intersection of the mounting bore axes.

Figure 2:
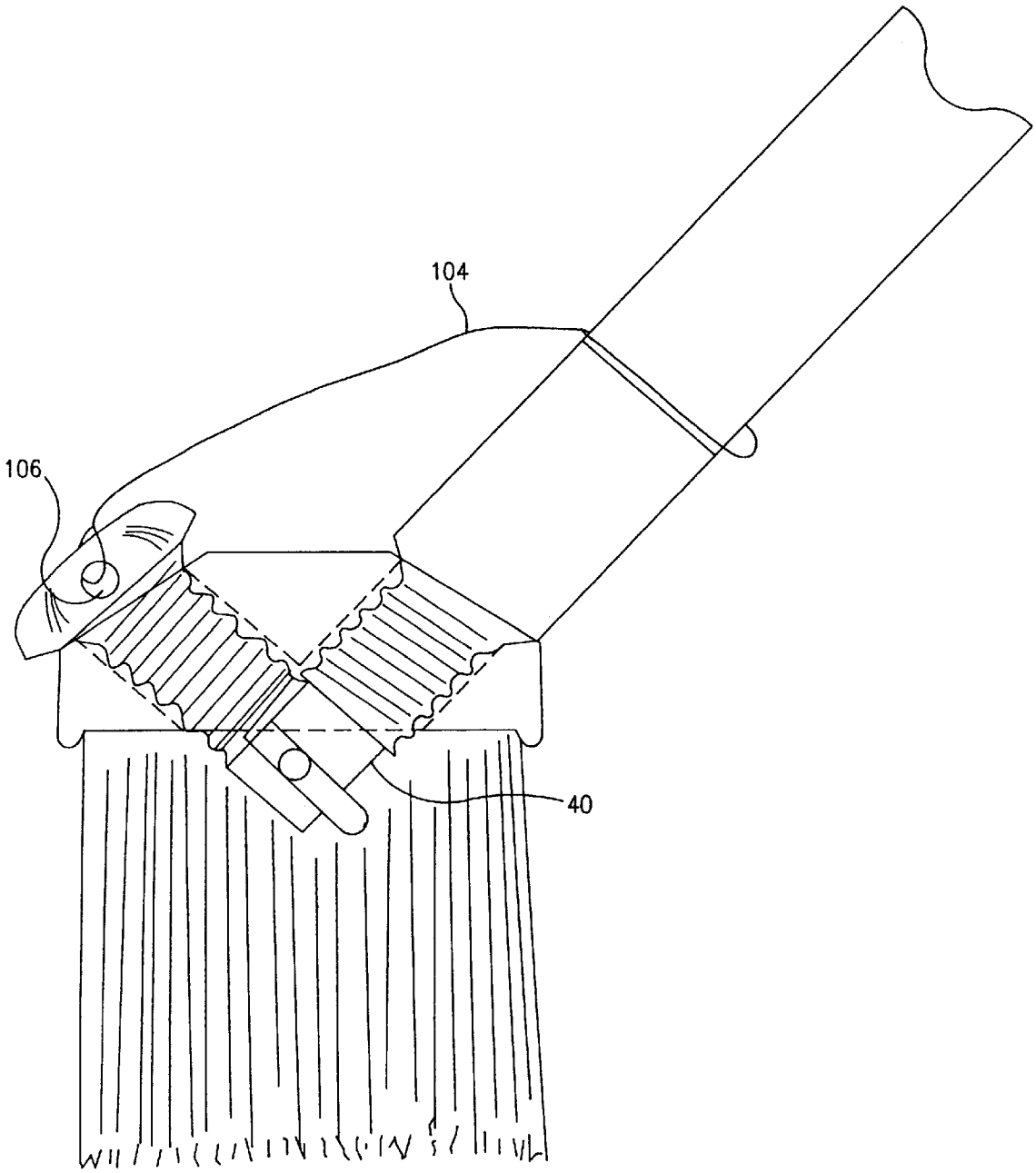
FIG. 2 is a side view, partly in schematic and partly in phantom, of a locking assembly of the invention installed to a broom head, with portions of the broom head removed to illustrate a second embodiment of the invention.

As shown in FIG. 2, the ferrule free end 32 may also include a concentric unthreaded extension 40, with the ferrule transverse aperture 36 located in this extension 40. The extension 40 may be round or include at least one substantially flat face angularly positioned around the handle longitudinal axis. It should be understood that the handle, if constructed of a sufficiently strong material, may include the same features as a ferrule for use with a locking plug and head in the same manner as the ferrule.

The locking plug 16 includes a head 44 connected to a threaded shank 46. The shank free end terminates at a face 48 from which a locking pin 50 projects coaxially with a longitudinal axis of the locking plug 16. The threaded shank 46 of the locking plug 16 is adapted to threadably engage one of the head mounting bores 22, 24. As the locking plug shank 46 is threadably engaged within a mounting bore 24, the locking pin 50 will be driven into the mounting bore 24. Continued threaded engagement of the locking plug shank 46 within the mounting bore 24 will drive the locking pin 50 into a suitably positioned ferrule transverse aperture 36, thereby locking the ferrule 30 and attached handle 12 from rotational or axial movement. If the locking pin 50 is not perpendicular to the handle longitudinal axis when the locking plug shank 46 is threadably engaged within the mounting bore 24, the aperture 36 will need to be large enough to accommodate the angular offset of the pin 50 and aperture 36. Further threaded engagement of the locking plug 16 within its respective mounting bore 24 will engage the plug face 48 against the ferrule 30, additionally securing the ferrule 30 and handle 12 from rotational or axial movement.

While the head 44 and shank 46 of the locking plug 16 may be constructed of any suitable material, the locking pin 50 should preferably be of steel or other material strong enough to withstand the twisting forces applied to the pin 50 during use of the implement 10. The locking pin 50 should also be of sufficient length so that it will fully engage the ferrule transverse aperture 36.

Figure 4A:
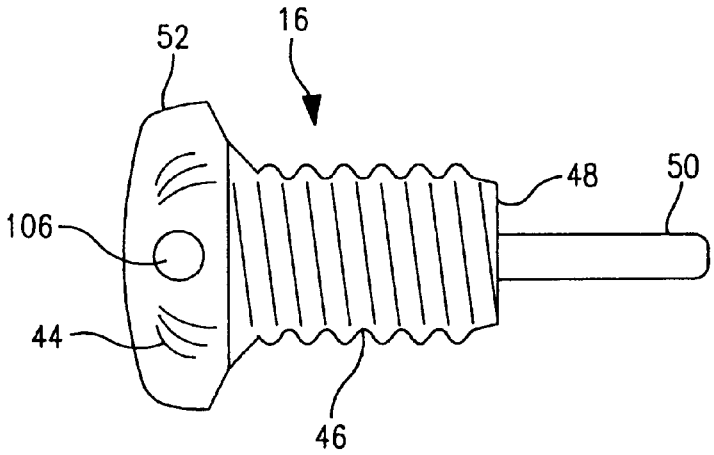
FIG. 4*a* is a side view of a locking plug of a locking assembly illustrating a plug head with wings for manual actuation.
Figure 4B:
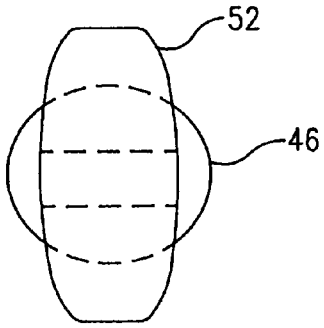
FIG. 4*b* is an end view, partly in phantom, of the locking plug of FIG. 4*a;*
Figure 5A:
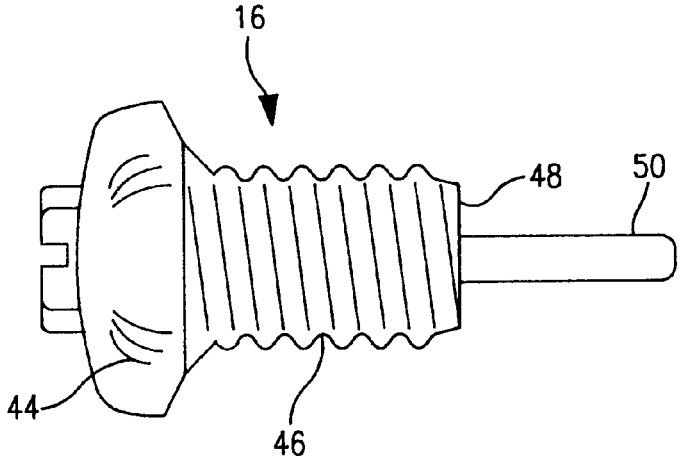
FIG. 5*a* is a side view of a locking plug of a locking assembly illustrating a plug head adapted for mechanical actuation in cooperation with a tool.
Figure 5B:
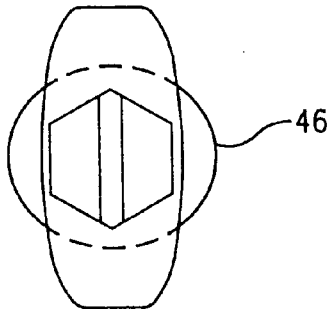
FIG. 5*b* is an end view, partly in phantom, of the locking plug of FIG. 5*a;*

The locking plug 16 may be adapted to ease manual actuation of the locking plug shank 46 into the mounting bore. This may be done by, for example, wings 52 projecting from the locking plug head 44 perpendicularly to the longitudinal axis of the locking plug 16. The wings 52 facilitate application of torque applied to the locking plug 16 with a user's fingers. See FIGS. 4*a* and 4*b*. Alternatively, as shown in FIGS. 5*a* and 5*b*, the locking plug head 44 may be adapted for cooperation with a tool to permit mechanical actuation of the locking plug shank 46 into threaded engagement with the mounting bore. This adaptation may take any of a number of well known forms, such as, for example, slots, cross slots, or sockets within the locking plug head for cooperation with driver tools; or opposing flats on the locking head diameter for cooperation with wrenches.

Figure 3:
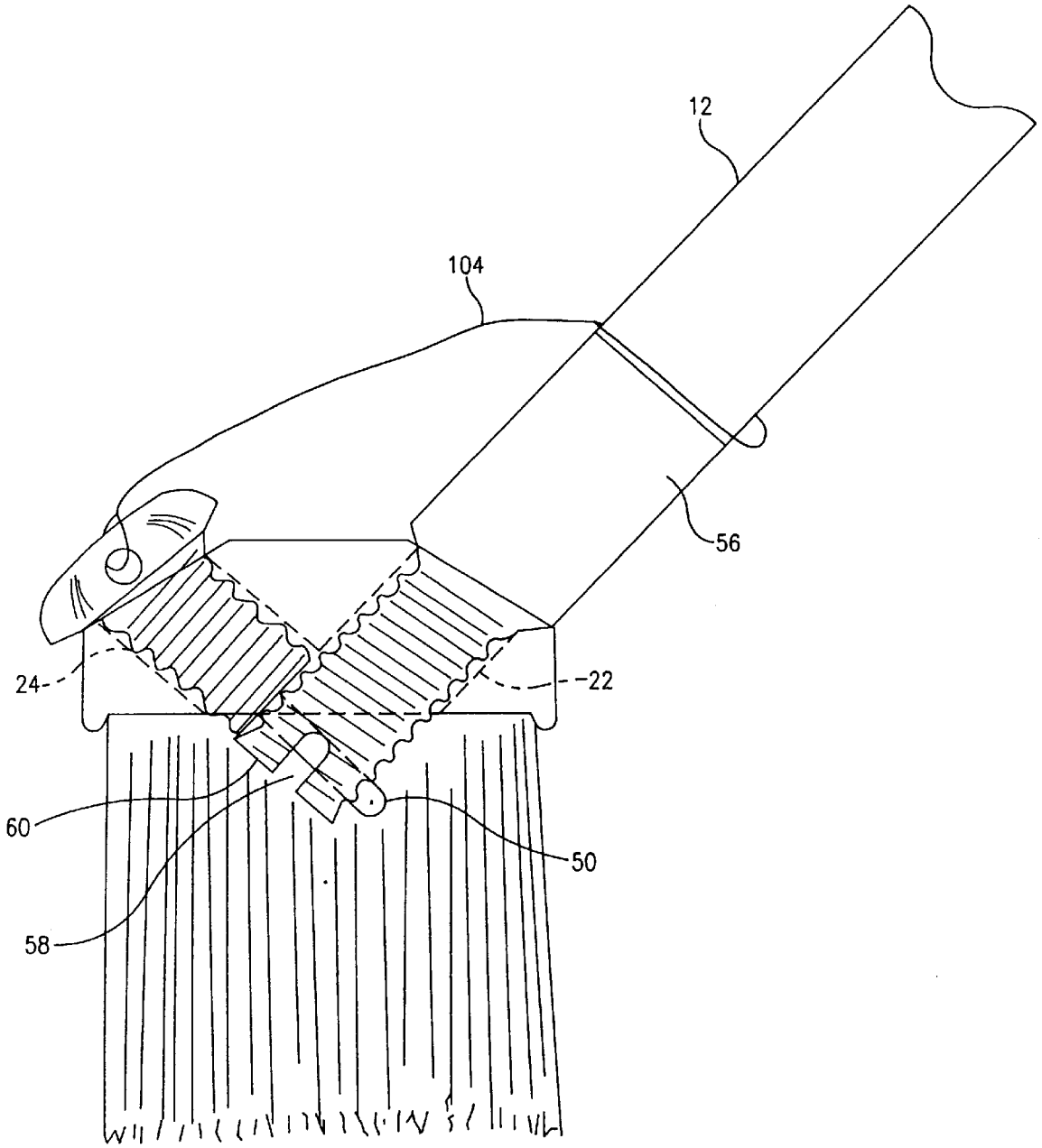
FIG. 3 is a side view, partly in schematic and partly in phantom, of a locking assembly of the invention installed to a broom head, with portions of the broom head removed to illustrate a third embodiment of the invention.

In another embodiment, shown in FIG. 3, the ferrule aperture is in the form of at least one transverse slot 58 slot originating at the ferrule free end 60 and progressing inwardly along the longitudinal axis. When the ferrule 56 is threadably attached to one mounting bore 22, the locking plug 16 can be engaged into the other mounting bore 24, with the locking pin 50 projecting into or through the slot 58. In this condition, the handle 12 is prevented from rotational movement, thereby locking the handle 12 to the head 14. For certain applications, the use of the slot 58 is advantageous over a transverse aperture 36 since the axial position of the slotted ferrule 56 within the mounting bore 22 is not critical and the locking pin 50 may engage the slot 58 at any of a plurality of axial positions. The locking pin 50 will not prevent axial movement of the slotted ferrule 56 and mounted handle 12 within the head 14 however.

Figure 6A:
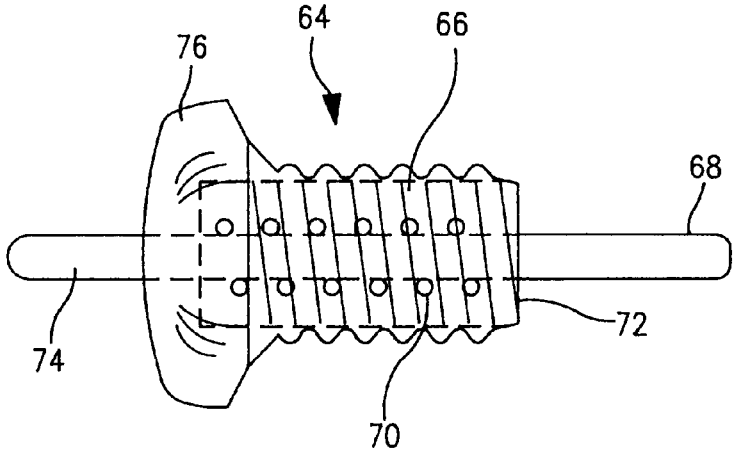
FIG. 6*a* is a side view, partly in phantom, of a locking plug of a locking assembly illustrating a displaceable locking pin biased into an extended position.
Figure 6B:
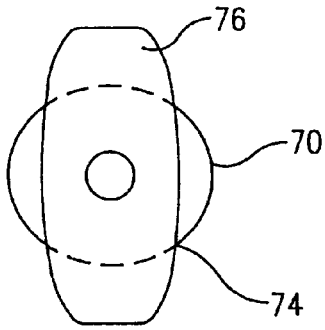
FIG. 6*b* is an end view, partly in phantom, of the locking plug of FIG. 6*a;*

In an alternative embodiment, shown best in FIG. 6*a*, the locking plug 64 defines an axial bore 66. The locking plug pin 68 is moveable within the bore 66 between an extended position projecting from the shank face 72 and a retracted position. The locking plug pin 68 is biased toward the extended position, such as by, for example, a spring 70. A handle 74 attached to the locking pin 68 extends beyond the locking plug head 76 to allow actuation of the locking pin 68 against the bias to the retracted position. As previously described, the locking plug 64 is engaged within a mounting bore. The displaceable locking pin 68 in the extended position cooperates with the ferrule transverse aperture 36 or slot 58 as previously described to secure the attached implement handle 12 from movement out of head 14. Actuation of the locking pin handle 74 moves the locking pin 68 to the retracted position, simultaneously withdrawing the locking pin 68 from the ferrule transverse aperture 36 or slot 58. With the locking pin 68 in the retracted position, the handle 12 may be freely rotated to assemble or disassemble the implement 10 without removal of the locking plug 64 from the head 14.

Figure 7:
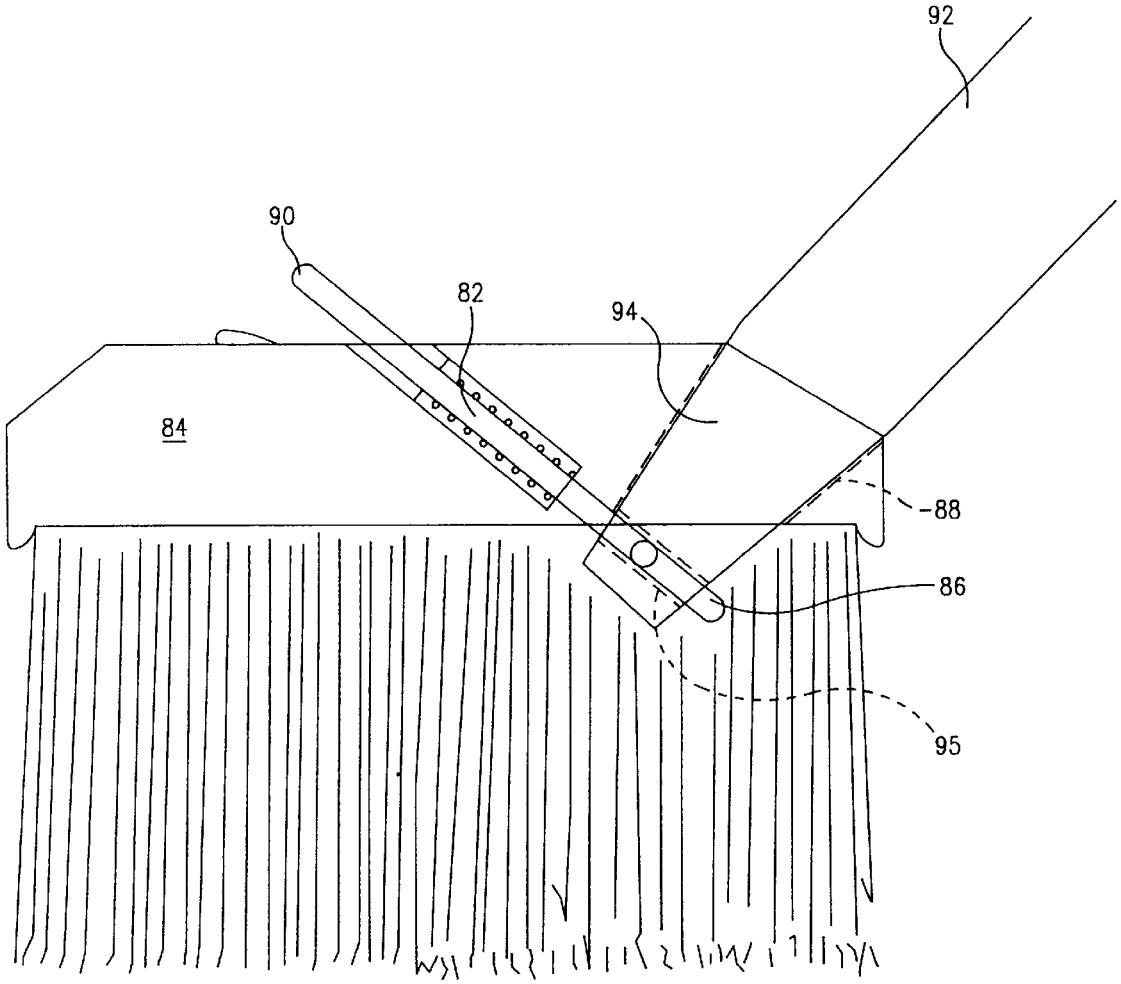
FIG. 7 is a side view, partly in schematic and partly in phantom, of a locking assembly of the invention installed to a broom head, with portions of the broom head removed to illustrate a fourth embodiment of the invention.

In different variation shown in FIG. 7, the locking pin 82 is mounted within the head 84 and biased toward an extended position with a pin locking end 86 projecting into an intersecting mounting bore 88. The opposing locking pin handle 90 projects from the implement head 84, allowing the pin 82 to be moved against the bias and out of the intersecting mounting bore 88. With the pin 82 retracted, the handle 92 may be moved into or out of the mounting bore. With the pin locking end 86 biased into the transverse aperture 95 of the handle 92, the handle is captured and prevented from moving either radially or axially. While the handle 92 is shown with a tapered end 94, which is a slip or interference fit in an unthreaded tapered mounting bore 88, this variation is also capable of securing a previously described threaded handle with either a transverse aperture or slot in a threaded mounting bore.

Figure 9:
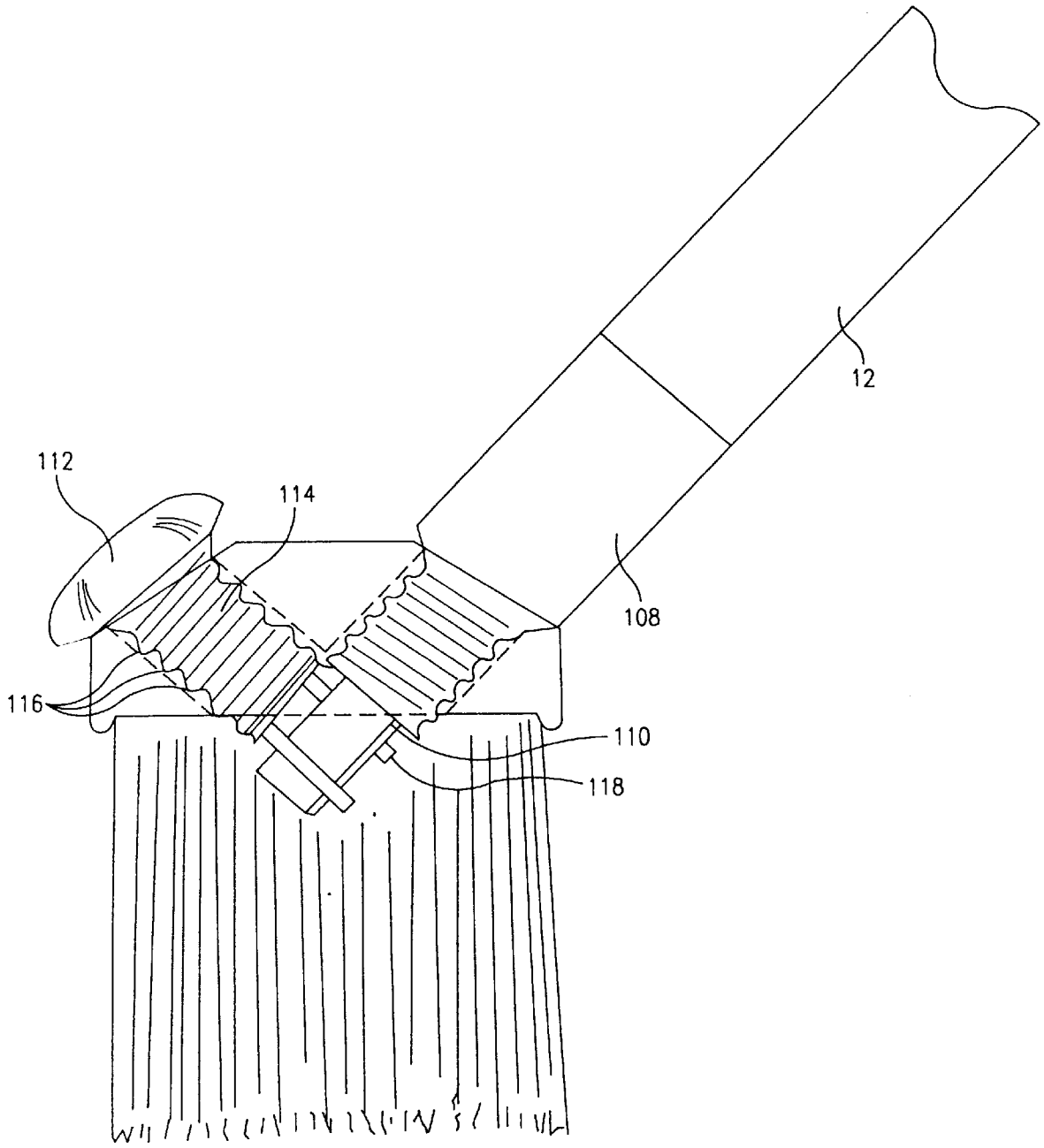
FIG. 9 is a side view, partly in schematic and partly in phantom, of a locking assembly of the invention installed to a broom head, with portions of the broom head removed to illustrate a sixth embodiment of the invention.

In a further embodiment shown in FIG. 9, a handle 12 is mounted to a threaded ferrule 108. The ferrule 108 includes a coaxially projecting shaped extension 110. The locking plug 112 includes a shank 114 with ridges 116 which is directly insertable in a head mounting bore. The ridges 116 prevent the locking plug 112 from backing out of the mounting bore. A yoke 118 is mounted to the shank 114. In use, the ferrule 108 is threaded into one mounting bore. The locking plug 112 is inserted in the other mounting bore, so that the yoke 118 engages the ferrule shaped extension 110. With the yoke 118 and extension 110 engaged, rotation of the ferrule end 108 out of the mounting bore is prevented.

Figure 8:
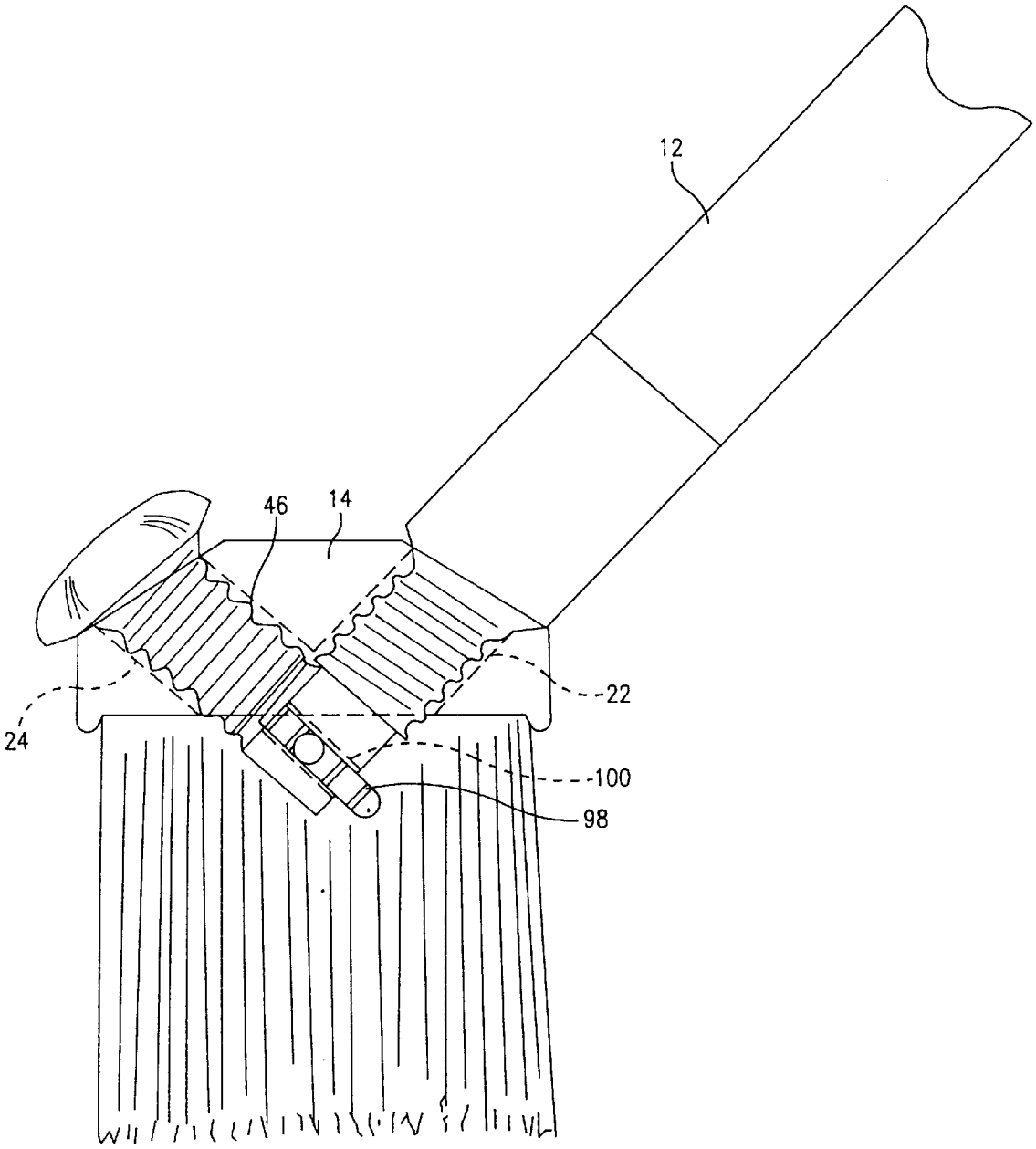
FIG. 8 is a side view, partly in schematic and partly in phantom, of a locking assembly of the invention installed to a broom head, with portions of the broom head removed to illustrate a fifth embodiment of the invention.

The disclosed embodiments are each capable of variation within the embodiment. In one variation the locking plug pin 98 and ferrule transverse aperture 100 are threaded at the same pitch as the mounting bores 22, 24. Threaded engagement of the locking plug shank 46 and the mounting bore 24 also serves to thread the locking pin 98 into the aperture 100, thereby securing the handle 12 to the implement head 14. See FIG. 8. In other variations, the outside surface of a handle or ferrule includes serrations or planar areas (not shown) for cooperation with the locking plug face to secure the handle to the head.

A retainer or a leash 104 may be attached to the locking plug 16 and either the handle 12 or ferrule 30, 56. At least one of the retainer 104 attachments must allow free rotation of the attached component so that the handle 12 may be rotationally assembled and dis-assembled from the head 14 without interference by the retainer 104. Preferably, the retainer 104 is permanently attached to the locking plug head 44 as by, for example, an aperture 106 in the locking plug head 44 and a loop of the retainer 104 permanently fastened therethrough. See, for example, FIGS. 1, 2 and 3.

It can readily be seen that the inventive locking assembly includes numerous advantages. Construction of the assembly is simple, inexpensive and requires no moving or pivoting parts. The locking assembly may be set or released manually. The locking mechanism is positive and requires no adjustments once set. No brackets must be attached to the implement head and any standard two hole head can be used. The locking assembly renders a normal head connection sturdy enough so that in some cases a heavy duty head with support arms or brackets is not necessary.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A lockable handle assembly for use with an implement head of the type having first and second mounting bores to create an implement, the assembly comprising:

elongated handle means for controlling said implement head, said handle means having mounting means engageable with one of said mounting bores and having first lock means for locking said handle means; and second lock means of locking said handle means, the second lock means comprising body means for engagement with the other of said mounting bores, the body means defining a longitudinal axis and end lock means projecting from an end of the body means, the end lock means displaceable toward the first lock means for selective engagement therewith, said second lock means simultaneously engageable with said implement head and said first lock means;

wherein said first and second lock means are engageable to lock said head and said handle means and said first and second lock means are disengageable to unlock said head and said handle means.

2. The lockable handle assembly of claim 1, wherein said end lock means includes a pin extending along the body means longitudinal axis and engageable with said first lock means to limit rotational movement of said handle means.

3. The lockable handle assembly of claim 2, wherein said first lock means defines an aperture and said pin is engageable within said aperture.

4. The lockable handle assembly of claim 3, wherein said pin limits rotational and axial movement of said handle means.

5. The lockable handle assembly of claim 2, wherein said pin is displaceable within said second lock means between an extended position and a retracted position, said pin not engageable to said first lock means in the retracted position.

6. The lockable handle assembly of claim 5, wherein said second lock means is permanently mountable within said implement head.

7. The lockable handle assembly of claim 1, wherein:

said implement head includes first and second threaded mounting bores defining convergent axes;

said handle mounting means is threadably engageable within one of said first or second mounting bores; and said second lock means is initially threadably engageable within the other of said first and second mounting bores and subsequently engageable with said first lock means within an intersection of said mounting bores.

8. The implement of claim 7 consisting essentially of the implement head, the handle means with the mounting means threadably engageable within one of said mounting bores, the second lock means threadably engageable within the other of said mounting bores and the first and second lock means engageable within said intersection of said mounting bores.

9. The lockable handle assembly of claim 7, wherein said second lock means includes a yoke movable through the other said mounting bore.

10. A lockable handle assembly for an implement having a head with first and second mounting bores defining convergent axes, comprising:

an elongated handle having first and second ends and defining a longitudinal axis, said first end defining an aperture and including a threaded portion, said handle threaded portion threadably engageable in one of said implement mounting bores;

a locking plug comprising a head, a shank connected to said head and defining a central axis and a pin projecting from said shank coaxially with said central axis, said shank engageable within the other of said implement mounting bores;

wherein said locking plug pin engages said handle aperture when said handle and locking plug are engaged in said implement mounting bores.

11. The lockable handle assembly of claim 10, wherein each of said mounting bores is threaded and said locking plug shank includes threads engageable with said other implement mounting bore.

12. The lockable handle assembly of claim 11, wherein said plug head includes means for facilitating manual rotation of said locking plug into threaded engagement with said implement mounting bore.

13. The lockable handle assembly of claim 11, wherein said plug head includes coupling means for coupling with a tool to facilitate rotation of said plug into threaded engagement with said implement mounting bore.

14. The lockable handle assembly of claim 11, wherein said plug shank terminates in a face, said pin projects from said face and said face engages said handle first end when said handle and locking plug are threadably inserted in said implement mounting bores.

15. The lockable handle of claim 14, wherein said handle first end terminates in an unthreaded shaft, said shaft defining said aperture.

16. The lockable handle assembly of claim 15, wherein said handle shaft includes a plurality of substantially flat faces angularly positioned around said handle longitudinal axis.

17. The lockable handle assembly of claim 10, including retainer means for retaining said plug to said handle.

18. The lockable handle assembly of claim 10, further comprising a ferrule coaxially disposed at said handle first end, said ferrule defining said threaded portion and said aperture.

19. The lockable handle assembly of claim 18, wherein:

said plug defines a longitudinal bore therethrough;

said pin is displaceable within said plug bore between an extended position projecting from said shank face and a retracted position substantially flush with said shank face; and including means for biasing said pin to said extended position; and means for facilitating displacement of said pin to said retracted position.

20. The lockable handle assembly of claim 10 wherein said first end aperture is a diametral slot penetrating said first end and intersecting said longitudinal axis.

21. A locking handled implement, comprising:

an implement head, said implement head having converging first and second threaded mounting bores each defined in a respective first and second mounting face;

a ferrule with a cylindrical end and an opposing control end, said cylindrical end having at least one aperture defined therein, said ferrule cylindrical end adapted for threaded engagement with one of said implement head mounting bores;

an elongated handle with a first end mounted to said ferrule control end;

a locking plug including a head portion, an opposing pin and a shank portion connecting said head to said pin, said shank portion adapted for threaded engagement with one of said implement head mounting bores;

wherein said pin is positionable within said ferrule aperture when said ferrule is threadably engaged with one of said implement head mounting bores and said plug is threadably engaged with the other of said implement head mounting bores.

22. The implement of claim 21, wherein said ferrule at least one aperture defines a diametral slot bisecting said cylindrical end.

23. The implement of claim 21, wherein said ferrule includes a shoulder between said cylindrical end and said control end, said shoulder engaging a respective said mounting face.

24. The implement of claim 21, wherein said pin projects from a shank face included on said shank, said shank face engageable to said ferrule cylindrical end when said ferrule and said plug are threadably engaged to said implement head mounting bores.

25. The implement of claim 24, wherein said pin is biased toward a first extended position projecting from the face of said plug and movable to a second retracted position between said first position and said face, said pin being positionable within said ferrule aperture when said pin is in said extended position and said pin not being positionable within said aperture when said pin is in said retracted position.

26. An implement, comprising:

an implement head having a face defining a mounting bore;

elongated handle means for controlling the head, the handle means having mounting means engageable within said mounting bore and first lock means for locking said handle means; and second lock means for locking said handle means, the second lock means comprising a body having an axially extending pin, the body and pin displaceably mounted within the head, wherein the pin is biased toward the first lock means for engagement therewith to prevent movement of the handle means within the mounting bore and the pin is displaceable toward the face to allow movement of the handle means within the mounting bore.

27. The lockable handle assembly of claim 1, wherein the implement head comprises first and second implement faces respectively defining the first and second mounting bores and second lock means is insertable through one of said implement faces and respective mounting bore to engage the first lock means.

* * * * *